US005966157A

United States Patent [19]

Dolan

[11] Patent Number: 5,966,157

[45] Date of Patent: Oct. 12, 1999

[54] METHOD FOR CLEANING RESIDUAL INK FROM A TRANSFER ROLLER IN AN INK JET PRINTING APPARATUS

[75] Inventor: Donald T. Dolan, Ridgefield, Conn.

[73] Assignee: Pitney Bowes Inc., Stamford, Conn.

[21] Appl. No.: 08/748,739

[22] Filed: Nov. 18, 1996

[51] Int. Cl.[6] ..... B41J 2/01; B41L 47/46

[52] U.S. Cl. ..... 347/103; 101/91

[58] Field of Search ..... 347/23, 33, 103; 101/425, 91, 492, 95

[56] References Cited

U.S. PATENT DOCUMENTS

| | | | |
|---|---|---|---|
| 2,660,111 | 11/1953 | Herrick et al. | 101/91 |
| 3,376,812 | 4/1968 | Sterling | 101/91 |
| 3,522,769 | 8/1970 | Priesmeyer | 101/3 |
| 3,536,007 | 10/1970 | Harvey | 101/327 |
| 3,688,695 | 9/1972 | James | 101/211 |
| 3,701,317 | 10/1972 | Miyameric | 101/170 |
| 3,724,369 | 4/1973 | Gery | 101/327 |
| 3,732,809 | 5/1973 | Sawada | 101/35 |
| 3,752,068 | 8/1973 | Trampoech | 101/93 |
| 3,869,986 | 3/1975 | Hubbard | 101/91 |
| 3,964,383 | 6/1976 | Delligatti | 101/44 |
| 4,052,938 | 10/1977 | Kirby | 101/291 |
| 4,116,126 | 9/1978 | Miner | 101/77 |
| 4,402,263 | 9/1983 | Honkawa | 101/350 |
| 4,403,547 | 9/1983 | Forberger | 101/170 |
| 4,493,993 | 1/1985 | Kanamuller et al. | 347/33 |
| 4,508,034 | 4/1985 | Schuneman | 101/365 |
| 4,538,156 | 8/1985 | Durkee et al. | 347/22 |
| 4,611,538 | 9/1986 | Simeth | 101/365 |
| 4,615,266 | 10/1986 | DeRoche et al. | 101/163 |
| 4,673,303 | 6/1987 | Sansone et al. | 347/103 |
| 5,608,430 | 3/1997 | Jones et al. | 347/8 |
| 5,614,933 | 3/1997 | Hindman et al. | 347/103 |
| 5,623,296 | 4/1997 | Fujino et al. | 347/103 |
| 5,677,719 | 10/1997 | Granzow | 347/103 |
| 5,805,191 | 9/1998 | Jones et al. | 347/103 |
| 5,862,753 | 1/1999 | Dolan et al. | 347/103 |

*Primary Examiner*—N. Le
*Assistant Examiner*—Thien Tran
*Attorney, Agent, or Firm*—Alberta A. Vitale; Melvin J. Scolnick; Robert H. Whisker

[57] ABSTRACT

A method for maintaining a transfer roller in an ink jet printer. In an ink jet printer having a transfer roller on which an image is formed by an ink jet printhead, the printhead is periodically purged to prevent clogging. During purging the ink discharged by the printhead is used to wet the entire surface of the roller to dissolve residual dried ink and the transfer roller is then cleaned with a wipping pad or roller.

8 Claims, 2 Drawing Sheets

START
69
OPTICAL DENSITY >FIRST PREDETERMINED LEVEL ?
NO
EXIT
YES
70
PRINTHEAD AT TRANSFER ROLLER ?
NO
72
POSITION PRINTHEAD
YES
74
ACTIVATE WIPER/ START ROLLER/ EJECT INK
76
LAST CYCLE ?
NO
ADJUST PRINTHEAD POSITION
80
YES
82
DEACTIVATE WIPER/
84
OPTICAL DENSITY <SECOND PREDETERMINED LEVEL ?
NO
88
SIGNAL REPLACEMENT NEEDED
YES
90
STOP ROLLER
EXIT

METHOD FOR CLEANING RESIDUAL INK FROM A TRANSFER ROLLER IN AN INK JET PRINTING APPARATUS

BACKGROUND OF THE INVENTION

The subject invention relates to an apparatus and method for printing images. More particularly, it relates to an offset printing apparatus incorporating an ink jet for producing images on a transfer roller for printing variable images such as postal indicia printed by postage meters to evidence that appropriate postage has been paid on a mail piece.

As evidence that postage has been paid, i.e. that the prepaid amount stored in the meter has been properly decremented, a postage meter will print a postal indicia on a mail piece. Typically, indicia have been printed by complex mechanical rotary or flat bed printing elements which include a fixed printing element for printing fixed information and adjustable elements for printing variable information.

Such meters have been highly successful and are presently used to account for the expenditure of billions of dollars of postage in the United States alone. However, in an effort to increase the security of these funds above the present high level, the U.S. postal service has proposed a standard which would require that the indicia include encrypted information which would vary from indicia to indicia so that counterfeit indicia could not be produced without knowledge of the encryption method and key used.

Additionally it is very advantageous to provide users of postage meters with the ability to print ads or slogans along with the postal indicia, and it would be highly desirable to enable these users to easily vary such ads or slogans.

In response to these needs the applicant has proposed an offset printing apparatus which incorporates an ink jet for producing images on a transfer roller. This printing apparatus is more fully described in commonly assigned co-pending U.S. patent applications Ser. Nos. 08/751,290 and 08/751,663, filed on even date herewith. (E-519 and E-557)

While it is expected that these apparatus will provide very substantial advantages in the printing of variable images such as postal indicia, some problems are anticipated. As is common with all ink jets conventional maintenance operations to prevent clogging of the ink jet nozzles are necessary. Further, as the number of print cycles increases it is expected that areas of dried and partially dried ink may form on the transfer roller; causing smearing on the envelope or other substrate.

Thus, it is an object of the subject invention to provide an improved method for maintenance of a printing apparatus which incorporates an ink jet for producing images on a transfer roller.

BRIEF SUMMARY OF THE INVENTION

The above object is achieved and the disadvantages of the prior art are over come in accordance with the subject invention by means of a method of maintaining a printing apparatus, where the printing apparatus includes a transfer roller, an ink jet mechanism for forming a reversed image on the transfer roller, and a cleaning mechanism for removing residual ink from the transfer roller. The method includes the steps of: first assuring that any substrate and any surface for supporting the substrate during printing are separated from the transfer roller, than operating the ink jet mechanism to eject ink from all nozzles for at least one full cycle of the transfer roller, and then operating the cleaning mechanism to remove the ejected ink together with the residual ink on the transfer roller which is dissolved in the ejected ink.

In accordance with one aspect of the subject invention, the printing apparatus includes an optical sensor for sensing the optical density of the surface of the transfer roller, and cleaning of the roller is initiated when the sensor detects ink build up above a first predetermined level on the surface of the roller.

In accordance with another aspect of the subject invention, the roller and cleaning mechanism are replaced if the sensor detects ink build up above a second predetermined level after the cleaning mechanism is operated.

Those skilled in the art will recognize that the subject invention achieves the above object and overcomes the disadvantages of the prior art and will recognize other objects and advantages of the subject invention from the detailed description set forth below.

DETAILED DESCRIPTION OF PREFERRED EMBODIMENTS OF THE INVENTION

Figure 1:
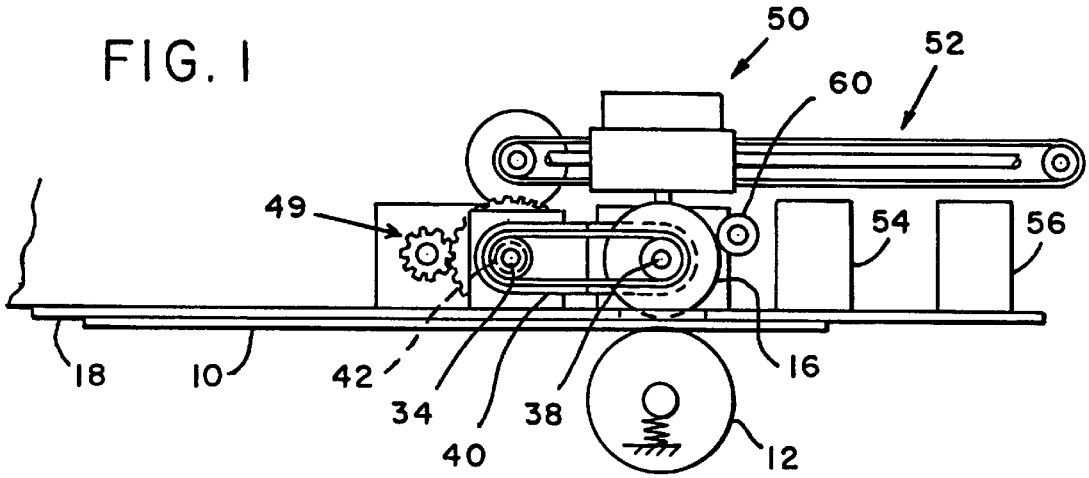
FIG. 1 shows a schematic side view of a printing apparatus in accordance with the subject invention.
Figure 2:
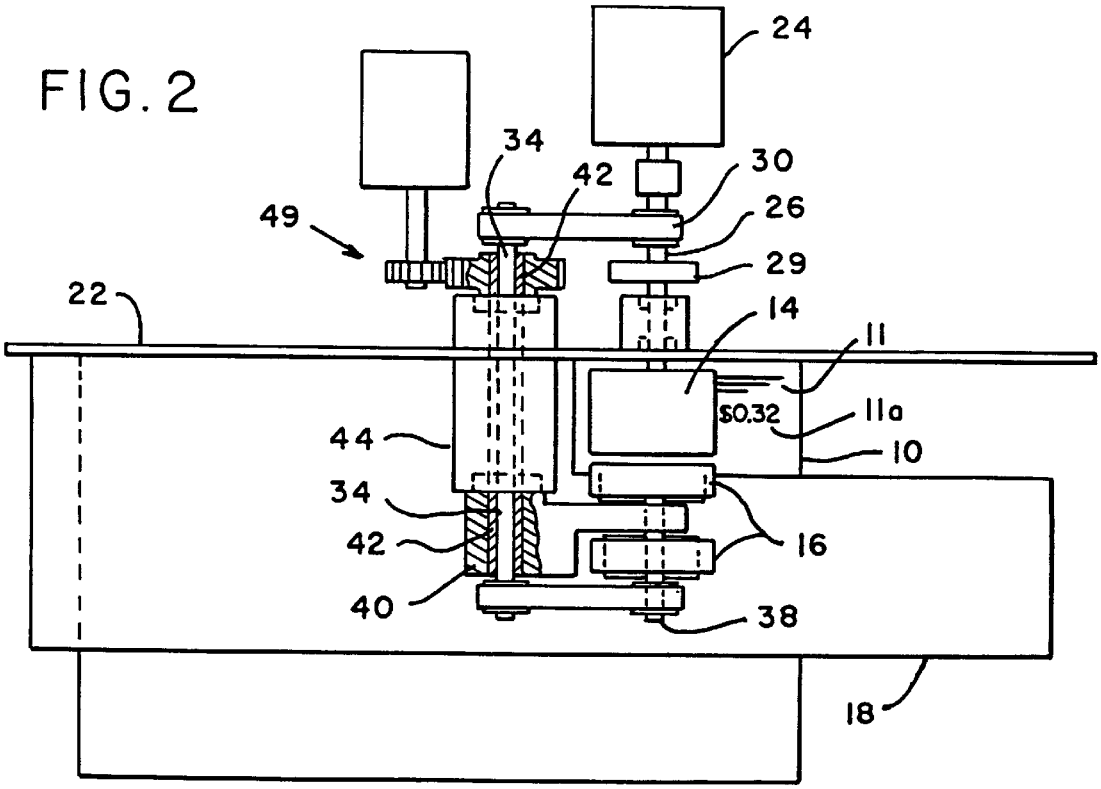
FIG. 2 shows a schematic top view of the printing apparatus of FIG. 1 with the image forming mechanism removed.

FIGS. 1 and 2 show schematic representations of a printing apparatus in accordance with the subject invention which is particularly adapted for printing postal indicia an envelopes.

Envelope 10 is fed to the printing apparatus of FIGS. 1 and 2 by a conventional demand feeder (not shown) which is controlled in a conventional manner to provide envelope 10 to the printing apparatus in synchronism with the operation of the printing apparatus to print indicia 11, which preferably includes representation of postage amount 11*a*.

Envelope 10 is fed into the nip formed by spring loaded impression roller 12, and transfer roller 14 and driven pivot rollers 16.

Envelope 10 is maintained in a predetermined registration with respect to transfer roller 14 by upper registration surface 18 and vertical registration surface 22.

Transfer roller 14 (shown in FIG. 2) is driven by print motor 24 through shaft 26 which is supported by bearing block 28. A conventional encoder 29 provides angular position information in a conventional manner to synchronize control of the printing operation, as will be describe further below. Pivot rollers 16 are also coupled to motor 24 by shaft 26, belt 30, inner coaxial shaft 34, belt 36, and shaft 38. Rollers 16 are thus arranged to rotate synchronously with, but separately from, transfer roller 14. Shaft 38 and rollers 16 are supported by pivot arm 40 which is fixed to outer coaxial shaft 42, supported by pivot bearing block 46.

Shoe 48 is fixed to pivot arm 40 and is normally co-planar with registration surface 18.

Pivot motor 48 drives outer shaft 42 through reduction gear assembly 49 to rotate pivot arm 40, rollers 16 and shoe 48 downwards out of the plane of registration surface 18 to deflect envelope 10 away from transfer roller 14 as envelope 10 moves through the printing apparatus as will be described further below.

Turning to FIG. 1 ink jet printhead 50 is supported in a predetermined registration with transfer roller 14 so that the nozzles of printhead 50 are arranged in a line parallel to the axis of transfer roller 14 preferably at a location 180 degrees from the nip of transfer roller 14 and impression roller 12. Transport mechanism 52 supports printhead 50 and, under system control, transports printhead 50 to maintenance station 54 and capping station 56 between printing operations. Transport mechanism 52 also transports printhead 50 in the vertical direction (i.e. the direction parallel to the axis of transfer roller 14 and transverse to the print direction) to interleave successive portions of a completed image in successive passes (i.e. revolutions of transfer roller 14) in order to produce images with increased vertical resolution. Print head 50 is conventional and details of its design form no part of the subject invention.

In other embodiments of the subject invention timing of operation can be adjusted to interleave dots in the horizontal direction.

Roller or pad 60 comprises a cleaning mechanism which is operated under system control to bear against transfer roller 14 and remove any excess ink remaining after an image has been printed on envelope 10. Other suitable forms of cleaning mechanism are within the contemplation of the subject invention and details of particular designs used for cleaning roller 14 form no part of the present invention.

Conventional optical sensor 62 is mounted on printhead 50 to sense the optical density of the surface of transfer roller 14. The output of sensor 62 is monitor by the system control (not shown) as a measure of the amount of residual ink dried open the surface of rollers 16, as will be further described below.

A more complete description of transport mechanism 52 is provided in commonly assigned, co-pending U.S. patent application Ser. No. 579,505, filed: Dec. 27, 1995, for: APPARATUS FOR PRINTING AN IMAGE INDICATIVE OF VALUE SUCH AS A POSTAL INDICIA, by: Kawahara, which is hereby incorporated by reference.

Maintenance of ink jet printheads is a well known process for preventing the nozzles of a printhead from being clogged by dried ink. At a maintenance station such as station 54 the printhead will typically be purged by either expelling or drawing ink through each nozzle. (This ink is of course wasted.) Also typically a wiping mechanism is provided to wipe excess ink from the surface of the printhead. The printhead is then transferred to a capping station (which may be integral with the maintenance station) to cap the printhead against exposure to air to inhibit drying of ink in the nozzles.

Another problems which can arise with printing mechanisms such as that shown in FIG. 1 is that, even though transfer roller 14 is preferably formed of a material which will efficiently transfer an image to a substrate such as envelope 10 and cleaning mechanism 60 is provided to further assure the removal of residual ink, over a large number of cycles residual dried ink may accumulate on the surface of transfer roller 14.

Figure 3:
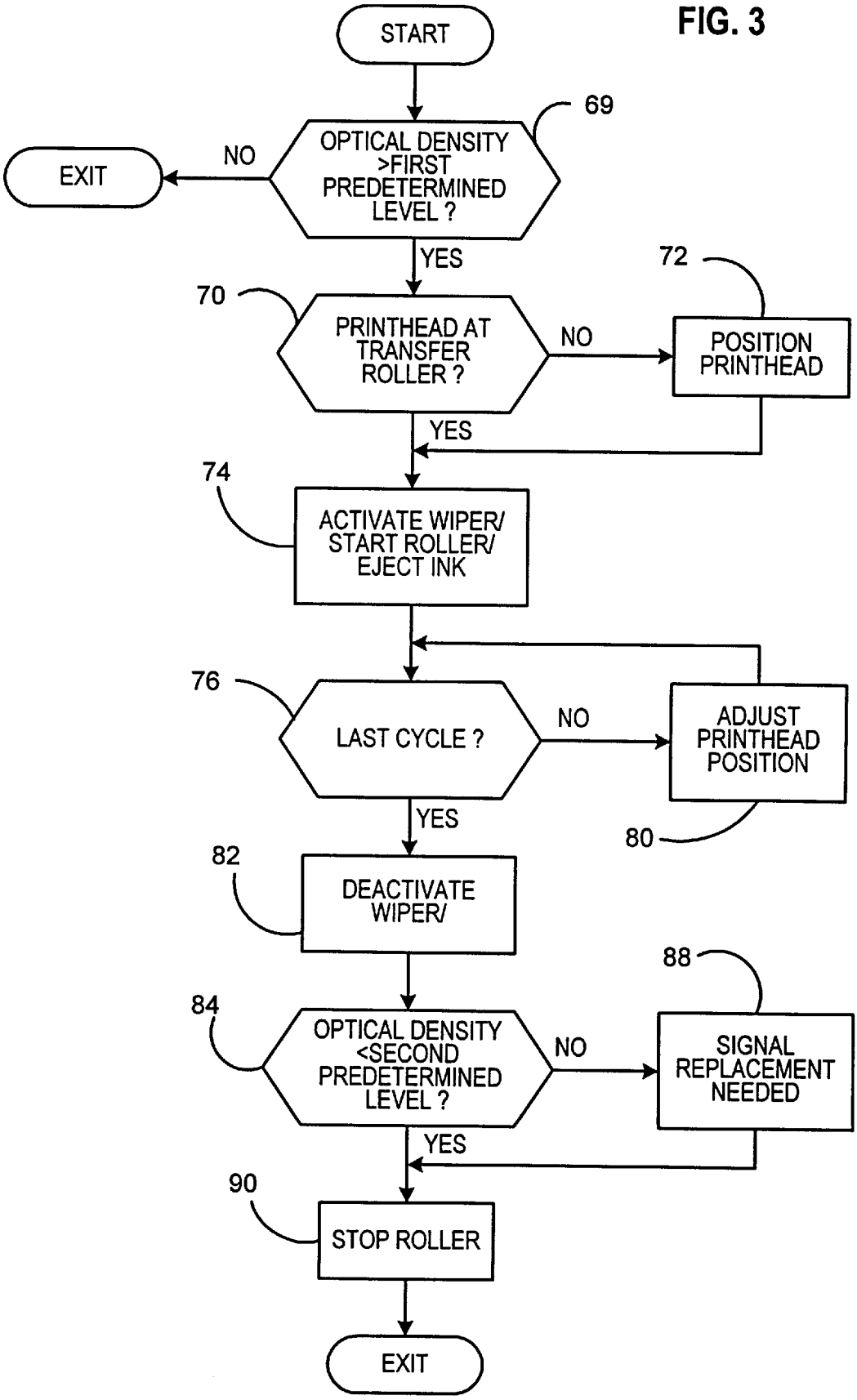
FIG. 3 shows a flow chart of the operation of the printing apparatus of FIG. 1 in accordance with the method of the subject invention.

FIG. 3 shows a method of operation of the print apparatus of FIG. 1 to use ink which would normally be used to purge printhead 50 as a solvent to clean residual dried ink from transfer roller 14.

At 69, a cleaning cycle is initiated by the system controller (not shown) when the output of optical sensor 62 indicates that the optical density of the surface of rollers 16 has exceeded a predetermined level, indicating that an excessive amount of residual dried ink has accumulated on the surface, and otherwise exits. In other embodiments of the subject invention a cleaning cycle can be initiated from time to time when it is determined that maintenance of printhead 50 is necessary.

(The manner in which the output of sensor 62 is converted into a level representative of the amount of residual dry ink will general vary from application to application, as will the choice whether this level should be determined as an average of the output of sensor 62, or as a peak of the output, or some combination thereof. Appropriate functions for converting the output of sensor 62 into a level can easily be determined by a person of ordinary skill in the art by experimentation for particular applications of the subject invention.)

At 70 the system controller determines if printhead 50 is at transfer roller 14, and if not, at 72 moves printhead 50 to roller 14. When printhead 50 is at roller 14 then, at 74, wiper 60 is activated, roller 14 is started and printhead 50 is controlled to continuously eject ink through all of its nozzles. Then at 76 the system determines if this is the last cycle, or revolution, of roller 14 and, if not, at 80 adjust the position of printhead 50 and/or the timing at which dots are printed, to assure that ink is ejected over roller 14 with the same vertical and horizontal resolution with which the postal indicia are printed, as described above. Once the last cycle is completed then at 82 wiper 60 is deactivated and at 84 the system again tests the output of sensor 62 to determine if the amount of residual dried ink is below a second predetermined level; i.e. is roller 14 clean? If not then at 88 the system signals an operator that roller 14 and cleaning mechanism 60 should both be replaced since the level of residual dried ink cannot be reduced sufficiently. At 90 roller 14 is stopped and the system exits the cleaning routine.

The above description of preferred embodiments of the subject invention has been provided by way of illustration only and numerous other embodiments of the subject invention will be apparent to those skilled in the art from consideration of the detailed descriptions set forth above and the attached drawings. Accordingly, limitations on the subject invention are to be found only in the claims set forth below.

What is claimed:

1. A method of cleaning a printing apparatus, said apparatus including a transfer roller for transferring an image to a substrate and an ink jet printhead for forming a reverse of said image on said transfer roller and a cleaning means for removing residual ink from said transfer roller, said method comprising the steps of:

a) assuring that said substrate, during printing, is spaced from said transfer roller;

b) operating said ink jet printhead to eject ink from all nozzles for at least one full cycle of said transfer roller, whereby substantially all of said transfer roller is wetted by ejected ink; and, c) operating said cleaning means to remove said ejected ink together with residual ink on said transfer roller which is dissolved by said ejected ink.

2. A method as described in claim 1, further comprising, prior to step a), the steps of:

sensing the optical density of the surface of said transfer roller using a sensor included in said printing device, said optical density corresponding to build-up of residual ink on said transfer roller; and initiating said cleaning method when said sensor detects ink build up above a first predetermined level on the surface.

3. A method as described in claim 2 comprising the further step of; if said sensor detects ink build up above a second predetermined level after step c), replacing said transfer roller and said cleaning means.

4. A method as described in claim 3 wherein said method is initiated to prevent said ink jet printhead from clogging.

5. A method as described in claim 2 wherein said method is initiated to prevent said ink jet printhead from clogging.

6. A method as described in claim 1 wherein said method is initiated to prevent said ink jet printhead from clogging.

7. A method as described in claim 1 wherein said ink jet printhead operates for more than one full cycle of said transfer roller.

8. A method as described in claim 1 wherein said method is initiated after a predetermined number of printing operations.

* * * * *